US005203190A

United States Patent [19]

Kramer et al.

[11] Patent Number: 5,203,190

[45] Date of Patent: Apr. 20, 1993

[54] METHOD AND APPARATUS FOR MAKING A HYDROCYCLONE SEPARATION CHAMBER

[75] Inventors: Roy W. Kramer; Robert B. Sivyer; Michael J. Thurmond; Daniel P. Lane, all of Houston, Tex.

[73] Assignee: Sivco, Inc., Houston, Tex.

[21] Appl. No.: 530,787

[22] Filed: May 30, 1990

[51] Int. Cl.[5] ..... B21D 39/20

[52] U.S. Cl. ..... 72/62; 72/61

[58] Field of Search ..... 72/54, 56, 60, 61, 62, 72/367; 29/421.1

[56] References Cited

U.S. PATENT DOCUMENTS

| | | | |
|---|---|---|---|
| 2,652,121 | 9/1953 | Kearns, Jr. et al. | 72/61 |
| 3,358,488 | 12/1967 | Fuch, Jr. | 72/62 |
| 3,358,489 | 12/1967 | Hutchins | 72/62 |
| 3,486,703 | 12/1969 | Sorlie | 72/61 |
| 3,534,573 | 10/1970 | Hall et al. | 72/62 |
| 3,871,094 | 3/1975 | Nichols | 72/62 |
| 4,751,835 | 6/1988 | Galaniuk et al. | 72/62 |

*Primary Examiner*—David Jones

[57] ABSTRACT

An elongate tubular member with a seamless frusto-conical interior wall surface having a selected taper angle of typically 5° or less which is formed from a metal tubular member of ductile material and circular wall cylinder configuration by the process of sequentially expanding contiguous length segments of the ductile tubular member to an interior frusto-conical wall configuration. The process involves inserting the tubular member into a female die member which defines an interior frusto-conical surface with a selected cone angle of typically 10° or less with the tubular member coaxially aligned with the die member interior surface. Contiguous length segment of the ductile tubular member are sequentially expanded into conforming engagement with the wall surface of the die member wherein the expansion of each length segment selected for expansion to frusto-conical configuration is achieved by application of hydraulic pressure to the interior of the tubular member at a pressure level which exceeds the yield strength of the ductile metal material. Each selected length segment of the tubular member is also of a length predetermined with respect to the taper angle and the ductility and wall thickness of the ductile metal tubular member such that the hydraulic pressure does not exceed the tensile strength of the tubular member. After each sequential expansion, the tubular member is annealed.

9 Claims, 4 Drawing Sheets

METHOD AND APPARATUS FOR MAKING A HYDROCYCLONE SEPARATION CHAMBER

FIELD OF THE INVENTION

This invention relates to a manufacturing process and a separation chamber obtained by the process of forming an elongated tube member having a seamless frustoconical interior wall surface from a cylindrical member of circular cross section where the formed tube member provides a separation chamber for hydrocyclones.

1. Background of the Invention

Hydrocyclones are an effective, simple and relatively low maintenance apparatus for centrifugally separating constituents of a mixture based on density of the constituents. Most hydrocyclones in present day use are designed for removing a more dense dispersion from a continuous phase. They do this by creating a vortex within the hydrocyclone body, which causes the dispersion to migrate radially outwards towards the walls, leaving a dispersion depleted continuous phase near the axis of the hydrocyclone. In recent years, development work has been directed towards separation of liquid/-liquid mixtures using a hydrocyclone. An industry problem that has lead to this development occurs in oil production. In a typical oil well production operation, the amount of produced water increases as an oil field matures. In some operations, the bulk of the volume of produced fluids may be water. Although there may be no direct economic incentive, recent tightening of government regulations in various parts of the world regarding the amount of oil in discharged waters has increased interest in improving and optimizing oily water separators.

This problem is particularly acute on offshore production platforms. There, the size and weight limitations on separation equipment limit the available options. Furthermore, on floating offshore platforms, the movement of the platform may affect the performance of some traditional types of separating equipment. The most traditional scheme utilized for cleanup of oily water on offshore platforms includes a weir type primary separator which allows the oily water to stand for a period of time such that free oil can accumulate at the top thereof and pass over a weir. The cleaner stream is then drawn off from the primary separator and directed to a flotation-type secondary separator. The flotation-type secondary separator is very large, on the order of the size of a large room, and is motion sensitive. As offshore fields mature and the volume of water production becomes greater and greater, traditional systems like the one just described become less and less practical.

In recent years, the use of hydrocyclone separators has been investigated and has proven to be a successful solution to the problem outlines above. As previously discussed, typical hydrocyclones are concerned with separating solids and fluids such as air. In these operations the disperse phase is heavier than the continuous phase, and therefore the disperse phase is centrifugally moved to the walls of the hydrocyclone leaving the continuous phase as a central vortex. On the other hand, when treating oil/water mixtures, nearly all oils are less dense than water and therefore when oil contaminated water is passed through a hydrocyclone, the radial acceleration of the vortex causes the oil droplets to migrate towards the hydrocyclone axis at the center of the vortex, leaving oil-free water near the walls of the hydrocyclone. This, therefore, puts different constraints upon the design of the hydrocyclone. Whereas, in a gas/solid separation, with a more dense dispersion, the majority of the continuous phase is removed through a vortex in the upstream end wall of the hydrocyclone as the overflow. The separated dispersion leaves with a small part of the continuous phase from the wall boundary layer in the underflow. When the dispersion is the less dense phase, the underflow becomes the greater proportion of the total throughput (90 to 99%) while the overflow (removing the dispersion from the hydrocyclone axis), is much reduced. Also, the more dense constituent upon reaching the hydrocyclone wall is held there in a relatively stable wall boundary layer, but the less dense dispersion that forms a core along the hydrocyclone axis has no such constraint and relies entirely upon the favorable internal flow structure for its stability and removal from the hydrocyclone without further disruption. With an oil dispersion in water, the density difference is relatively small (less than 10% that of most solids encountered) and, therefore, the design must not only produce regions of very fast spin to promote separation, but also be designed to avoid breakup of the oil droplets in regions of high shear. With these constraints in mind, the design of an efficient hydrocyclone for oily water separation, although perhaps superficially similar to the case of the hydrocyclone for the more dense dispersion, is essentially different in its requirements, leading to a rather different geometry.

One such difference in geometry is the provision of an elongated separation chamber having a continuous taper at a relatively small angle from the hydrocyclone axis. The shape of such a chamber is in the form of an elongated frustoconical chamber which forms a volume of revolution about the central axis of the hydrocyclone chamber.

One technique for manufacturing such an elongated structure has been to form the chamber in two halves and weld the chamber along a longitudinal seam. Another technique is to shape multiple longitudinal sections which are connected end to end. It must be remembered, however, that in an oil/water hydrocyclone, one of the design requirements is that the mixture not be subjected to shear forces within the hydrocyclone chamber. Any shearing of droplets of the dispersed phase will cause an emulsion of oil and water which is counterproductive to the separation process. Therefore, it is desirable to remove the problem of having an elongated seam or a circumferential seam to deal with in the construction of such a chamber. It is difficult when bonding metal surfaces, such as by welding, to totally eliminate any residual deformity in the mated surfaces so as to provide a smooth wall in the hydrocyclone. The use of the techniques just described for making hydrocyclones is also time consuming, and therefore expensive. In order to achieve the desired results outlined above, a swaging process was tried to form these elongated frusto-conical separation chambers. One problem encountered was that of removing the swaging die from the chamber after the forming operation. The low angle of attack combined with the elongated configuration of the separation chamber provides so much friction between the die and the formed part that removal of the die from the expanded product is a problem.

It is therefore an object of the present invention to provide a new and improved process for forming an elongated frusto-conical member having a small angle of taper.

Various forms of industrial and scientific equipment also can require the utilization of a relatively long tubular member having an interior surface of frusto-conical configuration. For forming relatively long thin-walled tubular metallic members with frusto-conical wall interiors with smaller diameters and under 10° taper angle it is not practical nor feasible to machine a single long tubular member with frusto-conical interior wall or to fabricate a plurality of small lengths of tubular members and attach these in end-to-end coaxial relationship by welding. Machining processes are not accurate and many times not possible with taper angles under 10° (included angle) so that the resulting product is usually not a tubular member with a true frusto-conical interior surface. Where short lengths of tubular members are welded end to end, the heat from welding distorts the cross sectional shape to something other than true circular form. Similarly, longitudinal welds of semi-formed tubular members are egg shaped in cross section.

As discussed above, hydrocyclone vortex separators for oil/gas mixtures employ elongated, relatively small diameter tube members where a tube member has a frusto-conical interior wall surface with a cone angle of less than ten degrees. Such separators are used in the oil industry for separating oil and water from well fluid mixtures of oil and water. The separators require numerous vertically or horizontally arranged tube members each with an interior frustoconical surface having a small angle of taper, such as in the range of 3° to 5° or less. A typical hydrocyclone separator tube may include such a tapered section with, for example, a length of approximately 67 centimeters and a frusto-conical interior with an interior diameter of 3.5 cm at its entry end and 1.7 cm at the exit end. The separation of fluids, which is effected by cyclonic spiralling motion of the fluid mixture through the tube member, requires a true or smooth frusto-conical interior wall surface for efficient operation. Since the machining or casting of a tube member with such a wall surface is presently impractical for economic and efficiency reasons and is likely to result in imperfections or grooves in the surface, there is a need for a more practical and efficient method of forming long tube members with interior frusto-conical wall surfaces, particularly for hydrocyclone separator tubes.

2. Prior Patent Art

U.S. Pat. No. 4,544,486, inventor Noel Carroll, issued Oct. 1, 1985, shows expansion chamber geometry in accordance with this invention.

U.S. Pat. No. 4,764,287, inventors Derek Colman and Martin Thew, issued Aug. 16, 1988.

U.S. Pat. No. 4,849,107, inventors Derek Colman and Martin Thew, issued Jul. 18, 1989, shows curved wall hydrocyclones which would be applicable to the forming process.

SUMMARY OF THE INVENTION

The invention relates to a process for forming an elongated metal tubular frusto-conical member ("tube member") with a seamless frusto-conical interior wall surface having a taper angle of 5° or less (10° included angle for a conical surface) from a tubular member of circular cylinder wall configuration and to a product formed by such process.

The frusto-conical wall interior in a metal tubular frusto-conical member is incrementally formed in steps from an elongated metal tubular member of ductile material with a circular cylinder wall configuration. The ductile metal tubular member is first disposed end first into a female die member. The female die member has a first length or portion with an interior frusto-conical wall surface with a cone angle of 10° or less and the remaining length is cylindrical but with a larger internal diameter than the outer diameter of the ductile metal tubular member. The ductile metal tubular member is also disposed in coaxial alignment with the axis of the female die member thereby defining a frusto-conical annular space with a diverging conical surface of the die member relative to the outer cylindrical surface of the ductile metal tubular member. Liquid under pressure is applied to the interior of the tubular member to apply sufficient force to deform the wall of the tubular member to the inner wall of the die member yet less than the force required to rupture the wall of the tubular member. The tubular member is then removed and annealed to return the tubular member to its normal metallurgical condition. The annealed partially formed tubular member is then inserted into a die member which has the first length of frusto-conical wall surface and has a second length of frusto-conical wall surface for a second expansion and annealing. Successive lengths of a tubular member can be deformed by additional steps so that a continuous full length seamless interior conically shaped surface is formed.

In short, an elongated metal tubular frusto-conical member with frusto-conical interior wall surface is formed by sequentially and separately expanding interior contiguous length segments or lengthwise extending selected portions of the ductile metal tubular member into conforming engagement with the interior wall surfaces of female die members with successively arranged length segments. The expansion of each selected ductile metal length segment of a tube member into conforming engagement with an interior frusto-conical wall of a female die member is obtained by an application of hydraulic pressure to a selected interior length segment of the tubular member at a pressure level which exceeds the yield strength of the ductile material of the length segment of tubular member while the radial expansion of the remainder of the tube member is restricted. Each length segment of the ductile tubular member which is selected for expansion to frusto-conical configuration is of a length predetermined with respect to the taper angle, the ductility and wall thickness of the tubular member and relative to the hydraulic pressure level so that the tensile strength of each selected length segment is not exceeded. After each sequential expansion of a length segment the tube member is annealed.

In the present invention, a hydrocyclone separator tube is formed for use in separating lighter and heavier weight components of a liquid mixture where the tube has an interior, seamless frusto-conical wall surface about a central axis with a cone angle for receiving a radial input of a liquid mixture at its larger open end and for containing a spiraling forward fluid flow over a length of said tubular member so that heavier weight component of the liquid mixture is centrifugally moved outwardly toward the interior wall surface and a lighter weight component of the liquid is forced inwardly toward said central axis thereby separating the mixture into lighter weight components and heavier weight components.

The seamless wall surface of the tube is formed by sequential controlled radial expansions of sequential sections of a tubular member to sequentially tapered wall surfaces in die members with annealing of the tubular member between such sequential expansions.

Yet another aspect of the invention resides in forming a hydrocyclone separation chamber for separating liquid/liquid mixtures in an elongated frusto-conical shaped separation chamber having a cone angle less than 10° and wherein the separation chamber has a seamless wall surface formed by sequential controlled radial expansions of sequential sections of a tubular member into tapered wall surfaces in die members with annealing of the tubular member between such sequential expansions.

DETAILED DESCRIPTION OF THE INVENTION

Figure 1:
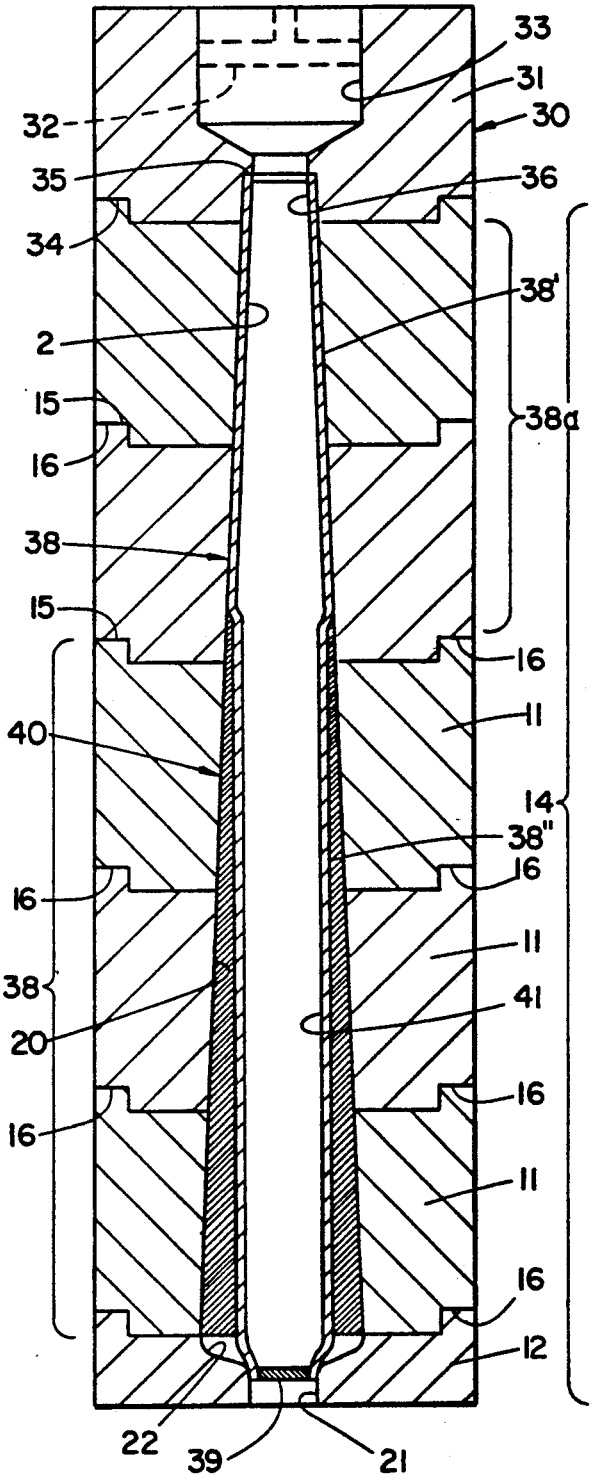
FIG. 1 is a view in vertical cross section of a tubular member which has been inserted in a female die member and connected at one end to a hydraulic press for applying hydraulic pressure to the interior of the cylindrical tubular member whereby a first length segment is expanded into frusto-conical configuration with the female die member while expansion of the remainder of the tubular member is restricted.

Referring more particularly to the drawings, there is shown in vertical cross section an assembly of die members 11 arranged in a vertical stack on a base member 12 to provide a female die assembly 14. The die members 11 and the base member 12 each have an outer cylindrical surface configuration and each of the members 11 and 12 is provided with an upstanding annular lip flange 15 and each of the members 11 and 12, except for the base member 12 are provided with an outer annular groove 16 at a lower surface for accommodating the upstanding annular lip flange 15 of the next adjacent member on which it is superposed. Each die member 11 is formed with a central axial opening which is machined therein to define a frusto-conical surface with a taper angle of 3° and an axial dimension of 6.1 inches, or approximately 15.75 cm. The frusto-conical surfaces in the several die members 11 are formed such that the longest diameter of the frusto-conical surface of each die member 11 corresponds to the smallest diameter of the frusto-conical surface of the next lower die member 11 whereby, in coaxial alignment, a uniform frusto-conical surface 20 with over-all length of 31 inches, approximately 78.75 cm, is defined by the die members 11. The base member 12 is also provided with a central axial opening 21 which, when the assembled die members 11 are supported by the base 12 is coaxially aligned with the axial openings of the members 11. The axial opening 21 is defined below a concave annular surface 22 having a largest diameter at the opening in its upper surface which conforms to the diameter of the frusto-conical wall surface of the next adjacent die member 11 superposed thereon. The wall surface defining the axial cylindrically shaped opening 21 preferably is about the same as the diameter of the frusto-conical wall surface 23 in the uppermost die member 11 at its upper opening in the upper surface of the die member 11.

A hydraulic press 30 is located at the upper end of the die members 11. The press 30 includes a piston-cylinder assembly with a hydraulic cylinder 31 and a piston 32 in a chamber 33. The press 30 is adapted for use with the female die assembly 14 (see FIG. 2). Accordingly, the lower end of the cylinder 31 is formed by an annular surface including an annular peripheral groove 34 and conforming in configuration to the upper surface of the upper most die member 11. The cylinder chamber 33 of the cylinder 31 is formed at its lower end, with internal threads 36 in a cylindrical bore section thereof which communicates with a larger diameter portion accommodating the piston 32. The threads 36 of the hydraulic press 30 are adapted to receive the threaded end of a ductile metal tubular member 38 from which an elongate frusto-conical tube member may be formed in accordance with the invention.

As shown in FIG. 1, the ductile metal tubular member 38 is attached be a threaded connection at its upper end to the press 30 and the lower end is disposed within the female die assembly 14. An O-ring 35 or other suitable seal means establishes a fluid-tight seal between the cylinder 31 and tubular member 38. The length of the tubular member 38 is such that a small portion of the lower end of the tubular member is snugly received in the cylindrical bore section 21 of the base 12. Also, at its lower end, the tubular member 38 is closed by a cap member 39 which may be welded or otherwise rigidly joined thereto.

The ductile tubular member 38 is preferably stainless steel characterized by a yield strength of approximately 30,000 p.s.i., however depending on a particular intended application, other ductile metal materials characterized by other yield strengths can be employed. The end cap 39 is of a material such as carbon steel alloy or titanium with a yield strength which not only exceeds the yield strength of the ductile tubular member 38 but also its tensile strength. The hydraulic press 30 is designed with a capability of delivering hydraulic pressures throughout a wide range of pressures up to as much as 80,000 p.s.i.

In accordance with the present invention, a length segment of the ductile tubular member 38 adjacent to the press 30 is first selected for radial expansion into conforming engagement with the adjacent interior frusto-conical wall surface of the female die assembly 14. An application of hydraulic pressure to the interior of the ductile tubular member 38 which exceeds the yield strength of the tubular member 38 will effect its radial expansion throughout its length if not restrained. If the radial expansion exceeds the tensile strength, the tubular member will burst or rupture. To avoid a rupture of the tubular member 38, the hydraulic pressure applied by the press 30 must not expand the tubular member to the point that the tensile or burst strength of the tubular member 38 is exceeded. Accordingly, the length segment of the tubular member 38 selected for expansion by a first application of hydraulic pressure, is predetermined in length with respect to the ductility, the wall thickness of the tubular member 38 and the particular taper angle of the interior wall surface of the die member 14. This may have to be empirically determined in some instances. In FIG. 1, this selected length segment 38' extends along a length **38*a* of the die member which corresponds to approximately one-third of the total length of the interior wall surface 20 of the die assembly 14. However, to preclude the possibility of a rupture of the tubular member 38 because of excessive expansion, it is necessary to restrict the radial expansion of the remaining length 38" of the tubular member 38**.

Figure 5:
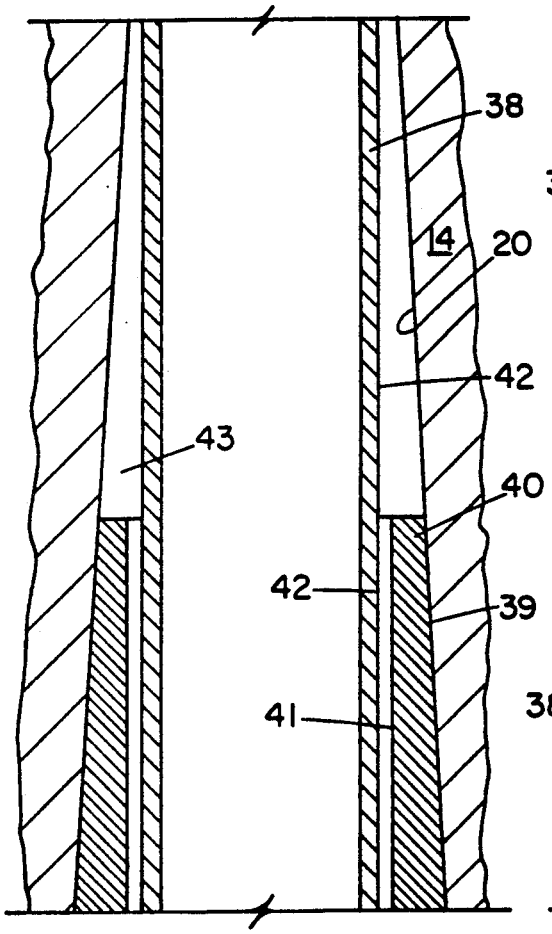
FIG. 5 is an enlarged partial view in cross section showing the lower end of a length segment and the upper end of an adjacent portion of a tube member prior to expansion.
Figure 6:
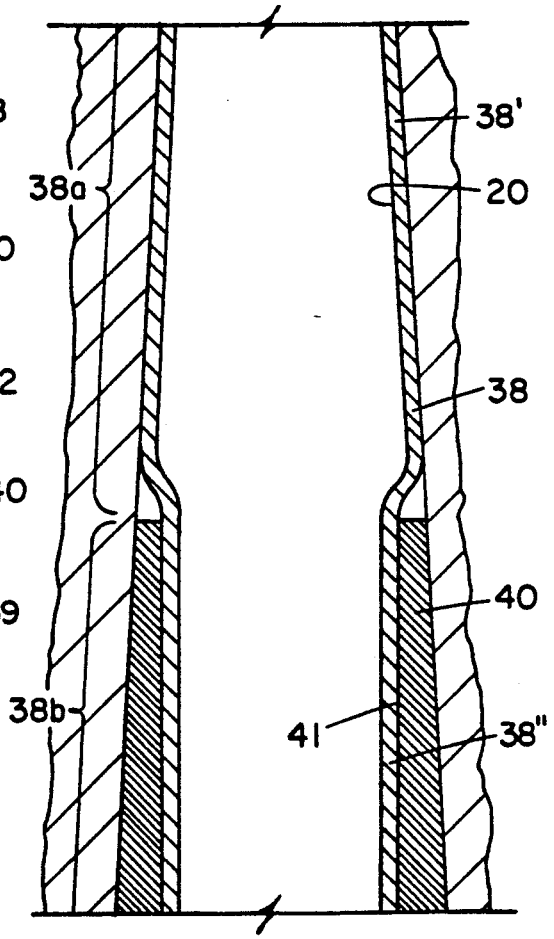
FIG. 6 is a view similar to FIG. 5 but after expansion of a tube member.

For the purpose of restricting the radial expansion of the remaining length 38" of the tubular member, a carbon steel sleeve member 40 is inserted into the female die assembly 14 from the lower end thereof during the assembly of the apparatus before the base 12 is connected. The sleeve member 40 has a length **38*b* which is equal to or slightly less than the length of the remaining unselected length segment 38" of the ductile tubular member 38 and is provided with an exterior tapered wall surface 39 which conforms to the frusto-conical die wall surface 20 along the length of the sleeve member 40. (See FIG. 5). The sleeve member 40 is also provided with a central axial cylindrical opening 41 with an inner diameter which is slightly greater than the external diameter of the outer wall 42 of the unexpanded ductile tubular member 38 and the annular space 43 (see FIG. 5) allows a uniform radial expansion of the sleeved portion of the tubular member 38 to a limited extent, the limited extent being that amount of radial expansion which can occur without same time as the length segment 38' is being deformed under pressure (enlarged) to the length segment 38*a* of the wall surface 20 of the die assembly 14, the remaining length 38" of the tubular member 38 in the length 38*b* of the sleeve member 40 is expanded radially to a limited extent to the cylindrical wall 41. As shown in FIG. 6, the length segment 38' of the tubular member which extends downwardly through the length 38*b* of the sleeve die 40 is reduced in wall thickness and expanded to conform to the taper of the wall 20 of the die assembly 14. The length segment 38" of tubular member 38 in the length segment 38*b* of the die sleeve 40 is radially expanded to conform to the die wall 41. The cylindrical wall of the length segment 38" of the tubular member is reduced in wall thickness due to the radial expansion. As is obvious, the wall thickness of the tubular member 38 should be sufficient to permit expansion over the entire desired expansion length of the tubular member 38**.

After the first expansion of the length segment 38' of the tubular member 38, the base 12, the die members 11 and the sleeve member 40 are disassembled from around the tubular member 38. The tubular member 38 is then disconnected from the press 30 so that the partially expanded tubular member 38 can be subjected to an annealing process which includes heating to a temperature of approximately 1800° F. (982.22° C.) and then air cooled whereby the stress and brittleness induced in the metal by the expansion process are relieved and the partially formed tubular member is in its original metallurgical condition.

After the initial expansion of the tubular member 38 provides the tubular member 38 with a predetermined length segment 38' of expanded section with a frusto-conical configuration and a smooth interior frusto-conical wall surface, a portion of the next contiguous length segment 38" of the tubular member 38 (see FIG. 6) is expanded to a frusto-conical wall configuration by following the steps of expansion described above to obtain a greater length of frusto-conical section.

Figure 2:
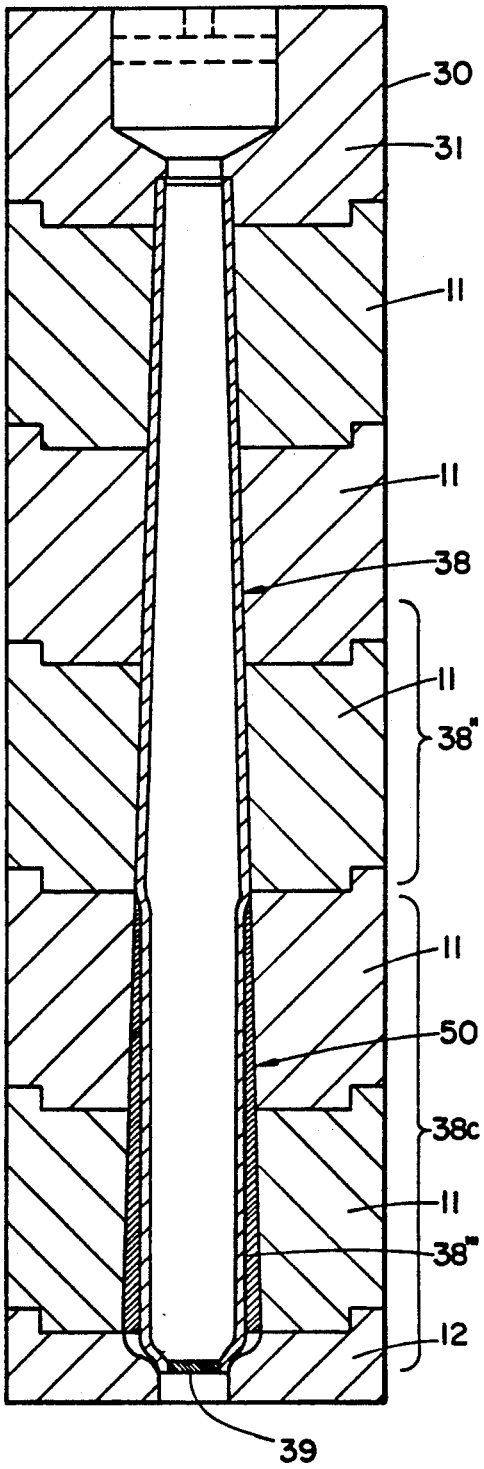
FIG. 2 is a view similar to FIG. 1 which shows radial expansion of a next adjacent length segment of the tubular member into frusto-conical configuration.

A second expansion of the tubular member 38 is illustrated in FIG. 2 wherein a second carbon steel sleeve 50 having a length **38*c* is inserted into the die member 14. The sleeve 50 serves to limit the radial expansion of a lower portion of the tubular length segment 38" while an intermediate length segment is expanded. For this second expansion operation a second or intermediate length segment of the tubular member 38 contiguous to the first frusto-conical expanded length segment 38' is selected for expansion into conforming engagement with the interior wall of the die member 14. This second length segment of the tubular member 38 is of a length predetermined with reference to the ductility and wall thickness of the tubular member 38 and the taper angle of the frusto-conical wall surface of the die member 14 in the same manner followed for determining the length of the first length segment 38' of the tubular member 38 which was selected for a frusto-conical expansion. The carbon steel sleeve 50, required for the second expansion is shorter in length but similar to the form of the sleeve 40 with the shorter length 38*c* corresponding to the remaining length of tubular member 38 to be precluded from a frusto-conical expansion. The sleeve 50 is also provided with an inner diameter which is somewhat greater than the outer diameter of the sleeve 40 to allow a further limited radial expansion of the sleeved portion of the tubular member 38 to cylindrical configuration without incurring a wall rupture. The application of hydraulic pressure to the interior of the tube member 38 to effect its second expansion, is also selected to be at a level which exceeds the yield strength of the metal but not the tensile strength of the tubular member 38. After the second expansion, the base 12, the die members 11 and the sleeve 50 are disassembled and the tubular member 38 disconnected from the press 30. As previously done, following the first expansion, the tubular member 38** is subjected to an annealing and air cooling process.

It will therefore be seen that by sequentially expanding contiguous length segments of the ductile tubular member 38 into conforming engagement with the frusto-conical wall surface of the female die members 11 and the use of sleeves, in the manner described above, it is possible to shape the entire length of the tubular member 38 to smooth surface frusto-conical configuration with a small taper angle.

Figure 3:
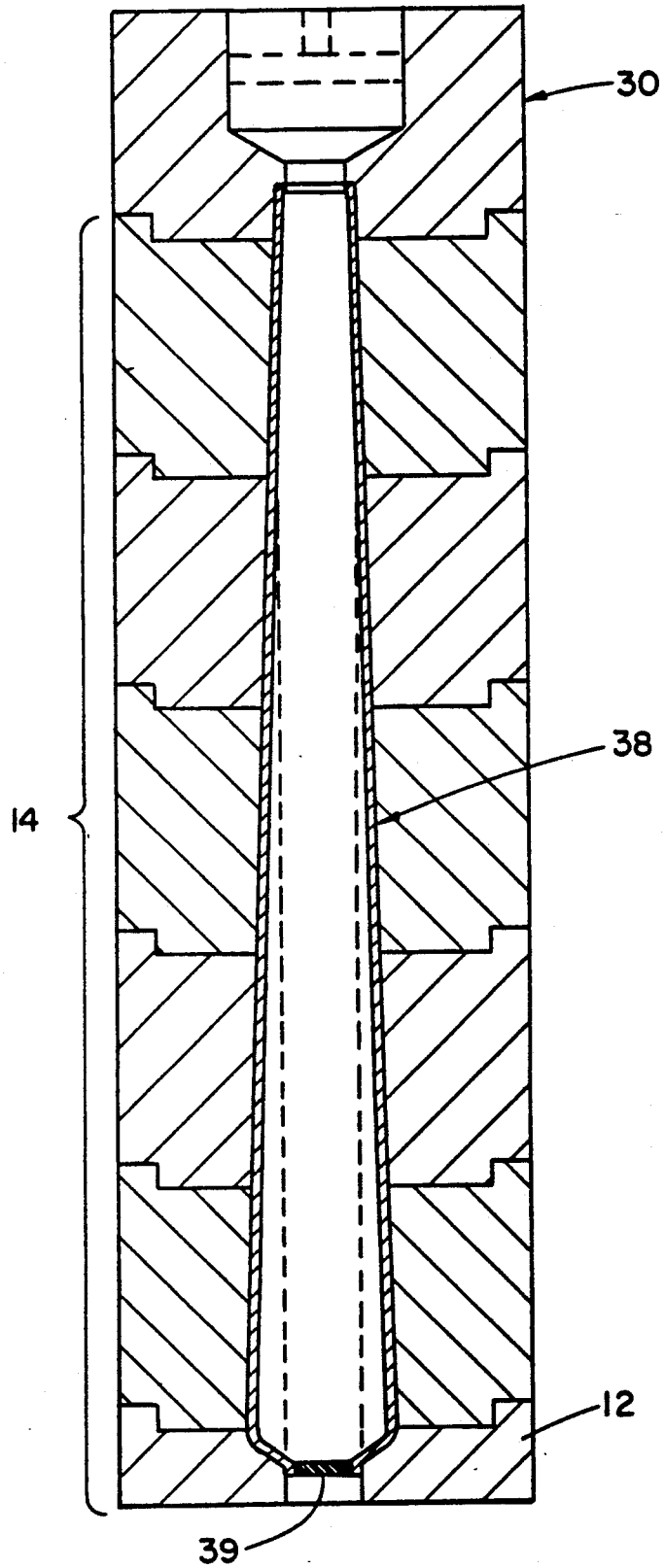
FIG. 3 is a view similar to FIGS. 1 and 2 showing the radial expansion of a final length segment of the tubular member which provides a tubular frusto-conical member with an interior frusto-conical surface of a desired length.

The results of a third expansion of the tubular member 38 is shown in FIG. 3 obtained by following the same sequence of steps as described for the first two expansions but wherein it was not necessary to use a sleeve since no further portion of the tubular member 38 was desired for frusto-conical expansion. It is to be noted that the portion of the tubular member 38 received in the base 12 is gradually expanded by each application of hydraulic pressure to ultimately conforming engagement with the concave surface of the base opening 21.

It will therefore be appreciated that a unique process for forming a tubular member with a seamless smooth frusto-conical interior wall surface and a unique product formed by such a process is described herein. The angle of taper in a product formed in accordance with the invention could be as large as 7° depending on the ductility and tensile strength of the cylindrical metal tubular member selected for expansion. The sequence of expansions to obtain a desired length of frusto-conical member may be of almost any number so long as an expansion does not exceed the tensile strength of the material.

Figure 4:
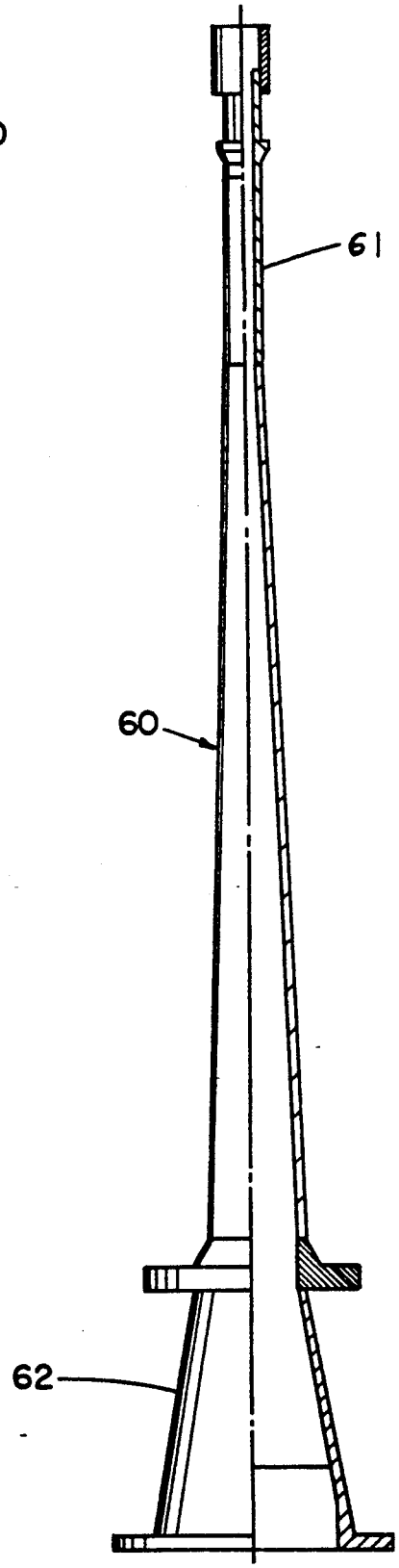
FIG. 4 is a plan view, partly in section, of a hydrocyclone separator tube incorporating a relatively long thinwalled section with frusto-conical interior surface which was fabricated in accordance with the invention.

A particularly useful application for the member having an elongated frusto-conical interior wall surface fabricated in accordance with the invention, is a hydrocyclone separator tube incorporated in vortex type fluid separators. Such a tube 60 is shown in FIG. 4, wherein the frusto-conical tubular member in its final form as shown in FIG. 3 may be used. Typically, the threaded end of the expanded tubular member 38 and the end portion thereof which is received in the base 12 are cut-off such that the remaining portion is provided with a smooth frusto-conical interior. As shown in FIG. 4, this portion may be welded at its narrow end to a cylindrical tubular member 61 and at its wider end to a tubular adapter member 62 having flanged ends and a larger interior frusto-conical surface which can be machined therein. In operation of such a tube 60 as a vortex separator, a mixture of fluids such as an oil-water mixture of well fluids is delivered by spiral injection into the larger end of the tube 60. The spiraling liquid creates large centrifugal forces which migrate oil to the central axis of the tube and the oil is subjected to a back pressure which creates a reverse axial flow and oil exits from the larger end of the tube while water is discharged through the small end of the tube to effect the separation and delivery of oil from one end of the tube.

Figure 7:
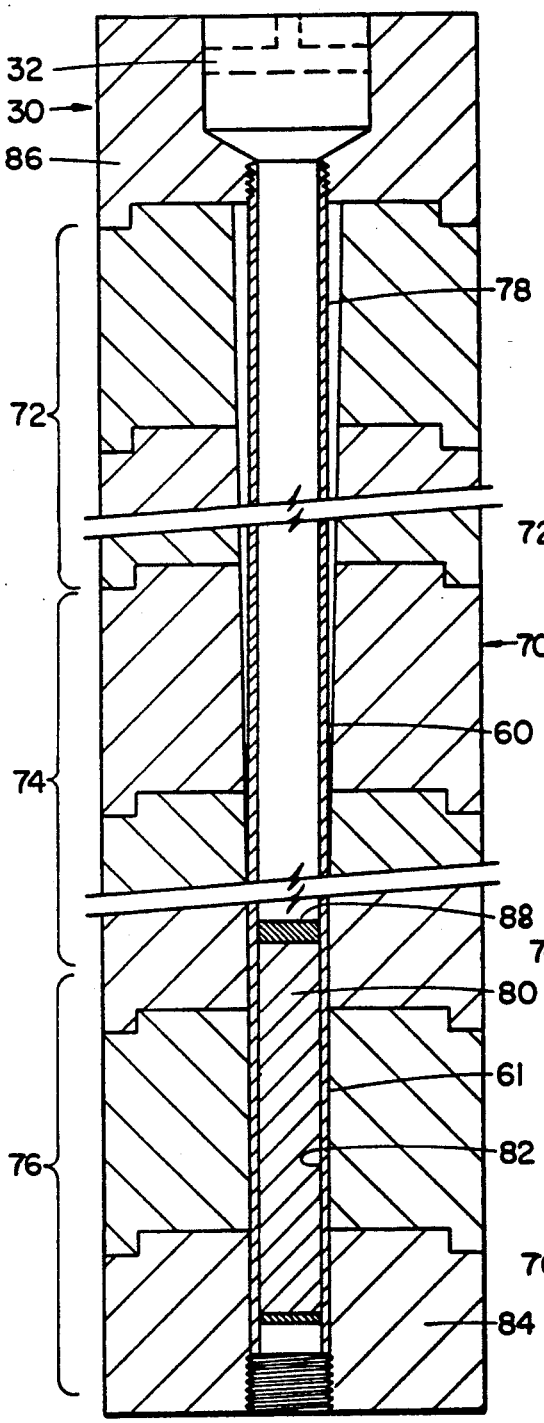
FIG. 7 is a view in cross section of another form of the present invention.
Figure 8:
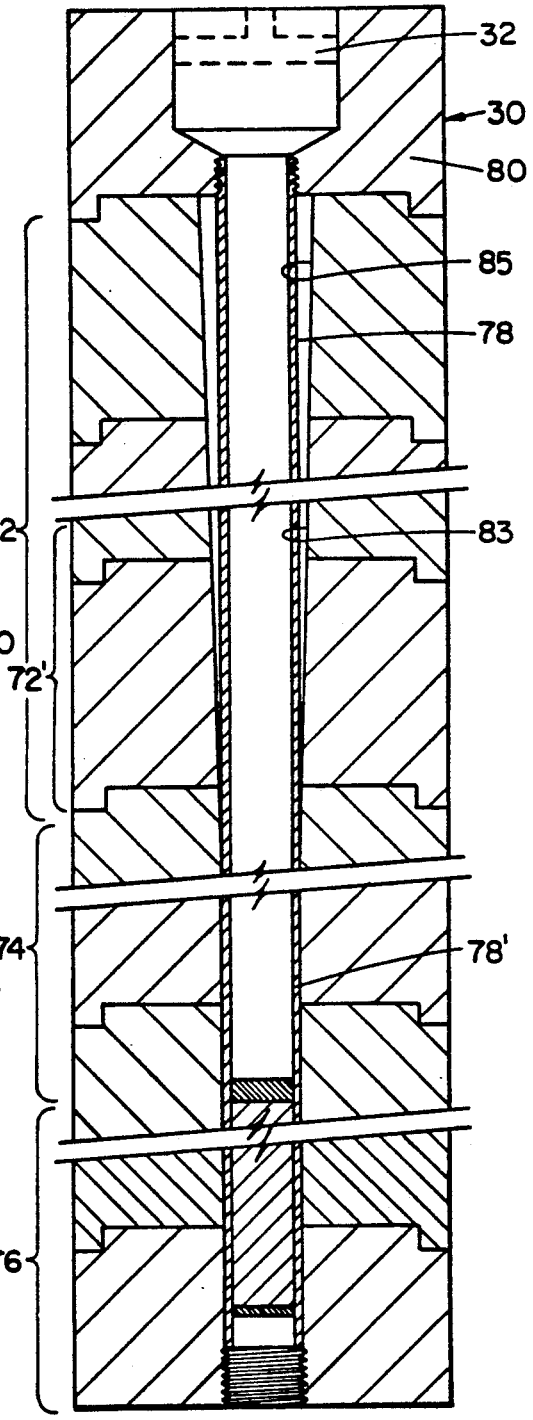
FIG. 8 is a view in cross section of another step of the process shown in FIG. 7.

Referring now to FIGS. 7 and 8, another form of the invention is illustrated. In FIG. 7, a die assembly 70 is illustrated wherein the die assembly is arranged with a first cylindrically shaped length segment 72, an intermediate frusto-conical length segment 74 with the desired taper angle and a second cylindrically shaped length segment 76. It is desired to form a tubular member 78 with adjoining sections where one length is substantially cylindrical such as section 61 of FIG. 4 and where the adjoining length is frusto-conical such as section 60 of FIG. 4.

In the forming process as described herein it is sometimes difficult to remove the deformed tubular member from straight cylindrical die sections. For that reason the cylindrical sections can have a slight taper relief to ease removal of the tubular member.

Where it is desired to maintain the cylindrical tubular shape, a closely sized cylindrically shaped bar member 80 is inserted into the bore 82 of the tubular section 61 to be maintained. At the upper end of the bar member 80 is a sealing means 88 such as a poly pack which provides a pressure seal. The pressure seal means 88 prevents the protected tubular section 61 from receiving pressure and thus protects against expansion to the bore of the die assembly which makes it difficult to remove the tubular member. As shown in FIG. 7, a tubular member 78 is threadedly connected with the lower die member 84 and the press member 86. The bar member 80 and the sealing means 88 are disposed in the section 61 to be maintained cylindrical. Adjacent to the portion 76 of the die assembly containing the section 61 of the tubular member is a first frusto-conical section 74 in the die assembly with included angle of 10° or less. Above the frusto-conical section 74 is a cylindrical section 72 which may have a slight taper for ease of removal. As described heretofore, hydraulic pressure is applied to the interior of the tubular member 78 to deform the tubular member to the frusto-conical section 74 and to the cylindrical section 72 of the die assembly. The sealing means 88 prevents enlargement of the section 61. After the first deformation, the tubular member is removed from the die assembly and annealed to return the tubular member to its initial metallurgical condition.

A second length segment is formed in the tubular member 78 in a second die assembly where a portion of the cylindrical section 72 is replaced with a die section 72' having a continuing taper with the die section 74. The tubular member 78 has the previously formed length segment 78' which is received in the die section 74. The tubular member 78 is disposed in a tapered die bore 83 which extends to a cylindrical bore 85. Upon the application of hydraulic pressure the tubular member conforms to the die bores 83 and 85. The tubular member is removed and annealed.

The final section is formed in a third die assembly which has a taper to continue the taper configuration of the die bore 83. The final section is formed and annealed as described herein with respect to FIGS. 7 and 8.

While the description has been of formation of a frusto-conical interior surface in three separate operations and an included cone angle of 10° or less it will be apparent that the number of operations required is a function of the metal ductility and metallurgical characteristics, the wall thickness, the length of taper and the angle of the taper. While an angle of 10° of less is referred to herein, the method is applicable to larger angles, however larger angles permit the formation of an interior seamless frusto-conical surface by machining and other mechanical processes.

It is to be understood that the foregoing description of a preferred embodiment of the invention has been presented for purposes of illustration and description and is not intended to limit the invention to precise form disclosed. For example, the die member assembly can be formed from various numbers and sizes of individual sections and these can be provided with any of a wide variety of interlocking means. Accordingly, it is to be appreciated that various changes may be made by those skilled in the art without departing from the spirit of the invention.

We claim:

1. A method of forming a frusto-conical tubular member to obtain a seamless, smooth frusto-conical interior wall surface, said tubular member being formed from an elongated tube member of metal material of known ductility and yield strength and having a pair of ends and a cylindrically shaped wall of specific wall thickness configured about a central longitudinal axis, said method including:

disposing one end of the tube member into a female die member having a pair of die ends and a frusto-conical interior wall surface which extends between said die ends to form a large opening at one of said die ends and a smaller opening at the other die end, said frusto-conical wall surface being configured about a central cone axis which is in substantially coaxial alignment with the central longitudinal axis of the tube member and said frusto-conical wall surface of said female die member being disposed at a taper angle relative to said cone axis;

applying hydraulic pressure to the interior of said tube member while said tube member is disposed in said female die member at a level of hydraulic pressure which is greater than the yield strength of the tube member to obtain an outward radial expansion of the wall of the tube member to conform to the interior wall surface of the die member;

during the step of applying hydraulic pressure, restricting the radial expansion of the wall of said tube member along a first predetermined length of said interior wall surface of the die member where said first predetermined length is measured from said large opening in the die member so as to allow radial expansion of the wall of said tube member into a conforming frusto-conical relationship with respect to the remaining length of the frusto-conical interior wall surface of said female die member to thereby form a first frusto-conical length segment of a tubular member, said first predetermined length being selected with respect to the taper angle of said frusto-conical wall surface of said die member and the ductility and wall thickness of said tube member so that the tensile strength of the tube member is not exceeded during the radial expansion, said step of restricting radial expansion of the wall of said tube member along said first predetermined length of the die member being controlled by disposition of a die sleeve of greater tensile strength than said tube member between said tube member and said die member in sleeved relation with the length segment of the tube member which throughout its segment length is axially coincident with said first predetermined length of the die member, thereafter annealing said tubular member;

sequentially repeating each of the aforementioned process steps to form one or more additional frusto-conical length segments of said tube member by successively expanding contiguous length segments of the tube member after each annealing step and in each step of restricting radial expansion of the wall of said tube member along each predetermined length of die member using a different die sleeve over the length segment of the tube member which is axially coincident with the selected predetermined length of the die member for providing a tubular member with a seamless, smooth frusto-conical interior wall surface.

2. A method as set forth in claim 1 wherein said tubular member is closed at the end which is inserted into the female die member by a cap member affixed thereto in fluid-tight sealing relationship and wherein said cap member is made of a material which has a tensile strength exceeding the tensile strength of the material of said tubular member.

3. A method of forming a frusto-conical tubular member with a seamless, smooth frusto-conical interior wall surface, said frusto-conical tubular member being incrementally formed from an elongated tube member of metal material of known ductility and yield strength with a cylindrically shaped wall of specific thickness by the sequential expansion of contiguous length segments of said cylindrical tube member and wherein said tube member is uniformly configured about a central longitudinal axis, said method comprising the steps of:

(a) disposing one end of said tube member into a female die member where the female die member defines an interior frusto-conical wall surface configured about a cone axis and having a cone angle of 10° or less so that the central longitudinal axis of the tube member is in coaxial alignment with the cone axis of the interior frusto-conical wall surface of said die member;

(b) applying hydraulic pressure to the interior of said tube member while said tube member is disposed in said female die member at a level of hydraulic pressure which is greater than the yield strength of said metal material of the tube member to radially expand the wall of the tube member;

(c) limiting the radial expansion of said tube member to a predetermined length where the wall of the tube member is brought into a conforming relationship with the interior wall surface of said female die member and thereby form a frusto-conical first length segment of tubular member;

said predetermined length being selected with respect to the ductility and wall thickness of said tube member of metal material and the cone angle of said frusto-conical wall surface so that the tensile strength of the tube member is not exceeded during the expansion of said first length segment;

(d) annealing said tube member after said radial expansion;

(e) disposing said tube member into a female die member where a second length segment adjacent to the first length segment is unrestricted relative to said interior wall surface of said last mentioned female die member and said first length segment is restricted by the frusto-conical wall surface of said first mentioned female die member;

(f) re-applying hydraulic pressure to the interior of said tube member and limiting the radial expansion of said annealed tube member to said second length segment so as to allow the radial expansion of the cylindrical portion of said tube member along said second length segment into conforming engagement with the interior wall surface of said last mentioned die member to form a second frusto-conical length segment which is contiguous and continuous with said first frusto-conical length segment with said first and second length segments in combination defining a tubular member with a single continuous smooth frusto-conical interior wall surface.

4. A method of forming a frusto-conical tubular member with a seamless smooth frusto-conical interior wall surface, said frusto-conical tubular member being incrementally formed from a metal tube member of ductile material with a cylindrically shaped wall by the process of:

forming said tube member in a first female die member which has a pair of ends and a die cavity extending to said ends and defined by an interior frusto-conical wall surface along a first wall segment configured about a cone axis with a cone angle of 10° or less and having a divergent end portion at one end of the die member and a convergent end portion at the other end of said die member and an interior wall surface along a second wall segment, and where the tube member has a length of tubing which is unconfined in one of said wall segments, in a first step applying hydraulic pressure to the interior of the tube member to provide sufficient force to expand said tube member along the unconfined length of tubing while restricting the expansion of said tube member along the other of said wall segments to prevent rupture of the wall of said tube member;

in a second step, annealing said tube member in its first expanded condition to restore its metallurgical properties;

in a third step, placing said tube member, in its first expanded condition after annealing, in a second female die member which has a second pair of ends and an interior frusto-conical second wall surface extending from one of said second pair of ends to the other end of said second pair of ends and which is provided with a greater length than said first wall segment and arranged so that in said first expanded condition, the tube member has an unconfined second length segment along said second wall surface and where such forming is achieved by applying hydraulic pressure to the interior of the tube member to provide sufficient force to further expand said tube member from its first expanded condition along the unconfined second length segment while restricting expansion of said tube member in said first expanded condition along the unconfined length to prevent rupture of the wall of the tube member in the second expanded condition; and in a fourth step, annealing said tube member.

5. A method of forming a frusto-conical tubular member with a seamless smooth frusto-conical interior surface as set forth in claim 4 wherein the first portion of said tube member which is selected for radial expansion into conforming engagement with the interior surface of said first die member is an end portion thereof which is disposed radially adjacent the divergent end portion of the interior surface of the die member.

6. A method of forming a frusto-conical tubular member with a seamless smooth frusto-conical interior surface as set forth in claim 4 wherein the first portion of said tube member which is selected for radial expansion into conforming engagement with the interior surface of said first die member is an end portion thereof which is disposed radially adjacent the convergent end portion of the interior surface of the die member.

7. A method of forming frusto-conical tubular member to obtain a seamless, smooth frusto-conical interior wall surface, said tubular member being formed from an elongated tube member of ductile metal material configured uniformly about a central longitudinal axis and having a pair of ends and a cylindrical tubular wall, said method including the steps of:

disposing one end of said elongated tube member into a female die member having an interior frusto-conical first wall surface configured about a cone axis with a taper angle relative to the cone axis of the die member over a first length segment of the die member and having a second wall surface with a cylindrical shape over a second length segment of the die member contiguous to said first length segment, and where the central axis of the elongated tube member is in substantially coaxial alignment with the cone axis of the interior frusto-conical wall surface of said female die member, and where the cylindrical tubular wall of the tube member is spaced from the wall surfaces of said first and second length segments;

applying hydraulic pressure to the interior of said tube member while said tube member is disposed in said female die member at a level of hydraulic pressure which is greater than the yield strength of the tube member to obtain an outward radial expansion of the wall of the tube member to conform to the wall surfaces of said first and second length segments in the die member;

during the step of applying hydraulic pressure, restricting the radial expansion of the wall of said tube member along the first and second length segments of said interior wall surface in the die member to allow limited radial expansion of the wall of said tube member into conforming engagement with said first and second wall surfaces over said first and second length segments without bursting said wall and thereby to form an expanded frusto-conical length segment and a contiguous expanded cylindrical length segment of said tube member;

said first and second length segments being selected with respect to the angle of taper of said frusto-conical wall surface, the diameter of the female die member, the ductility and the wall thickness of said tube member such that the tensile or burst strength of the tube member is not exceeded during the radial expansion and wherein the taper angle of said frusto-conical interior wall surface of the die member is less than 5° relative to said cone axis and thereafter annealing said tube member.

8. A method as set forth in claim 7 wherein the expanded frusto-conical length segment and the expanded length segment on said tube member are subsequently disposed in a second die member having an adjoining interior frusto-conical third wall surface over a third length segment of the die member where said third wall surface and said third length segment of the die member are at the same taper angle as said first wall surface and provide a continuation thereof, said method further including;

applying hydraulic pressure to the interior of said expanded length member while said tube member is disposed in said female second die member at a level of hydraulic pressure which is greater than the yield strength of the tube member to obtain an outward radial expansion of the expanded length section to the third length segment of the second die member;

during the step of applying hydraulic pressure, restricting the radial expansion of the wall of said expanded length member along said third length segment of the die member to prevent bursting of said wall thereby to form adjoining frusto-conical length segments; and thereafter annealing said adjoining frusto-conical length segments of said tube member.

9. A method of forming a frusto-conical tubular member with a seamless, smooth frusto-conical interior wall surface, said frusto-conical tubular member being incrementally formed from a metal tube member of ductile material of a known yield strength with a cylindrically shaped wall by the process of:

successively and sequentially expanding contiguous cylindrical segments of a tube member within successively arranged female die members by use of hydraulic pressure to successively form said tube member with a continuous interior frusto-conical wall surface with a cone angle of 10° or less by sequentially forming discrete and contiguous frusto-conical and adjacent lengths segments of said tube member and annealing such tube member after each forming step and wherein each of said expansions is achieved by an application of hydraulic pressure to the interior of said tube member at a pressure level which exceeds the yield strength of said tube member while restricting the radial expansion of said tube member in said die members so that the hydraulic pressure level does not burst the wall of the tube member.

* * * * *